United States Patent [19]

Engel

[11] Patent Number: 4,784,220

[45] Date of Patent: Nov. 15, 1988

[54] PIPE SPACING GRATE ROD SPACING HOLDER FOR HEAT EXCHANGERS

[75] Inventor: Ulrich Engel, Oberhausen, Fed. Rep. of Germany

[73] Assignee: Man Gutrhoffnungshütte GmbH, Fed. Rep. of Germany

[21] Appl. No.: 93,824

[22] Filed: Sep. 8, 1987

[30] Foreign Application Priority Data

Sep. 19, 1986 [DE] Fed. Rep. of Germany ..... 3631886

[51] Int. Cl.[4] ..... F28D 7/00; F28F 9/00

[52] U.S. Cl. ..... 165/162; 122/510; F28D/7/00; F28F/9/00

[58] Field of Search ..... 165/162; 122/510

[56] References Cited

U.S. PATENT DOCUMENTS

| | | | |
|---|---|---|---|
| 3,575,236 | 4/1971 | Romanier | 165/162 |
| 3,907,031 | 9/1975 | Tegethoff | 122/510 X |
| 3,941,188 | 3/1976 | Scheidl | 165/162 |
| 4,371,035 | 2/1983 | Soligno | 165/162 |
| 4,570,883 | 2/1986 | Wepfer | 165/162 X |

FOREIGN PATENT DOCUMENTS

| | | | |
|---|---|---|---|
| 2756592 | 6/1978 | Fed. Rep. of Germany | 165/162 |

*Primary Examiner*—Ira S. Lazarus
*Assistant Examiner*—Peggy Neil
*Attorney, Agent, or Firm*—McGlew and Tuttle

[57] ABSTRACT

The invention concerns a pipe spacing grate for guidance of pipes in heat exchangers, for example, steam generators, whereby the grate is formed of intersecting grate rods, arranged in more than one plane and encircled by a frame. The frame has a groove running about the inside for accommodation of the ends of the grate rods. The grate rods (3) in the frame (2) are kept at a definite spacing from each other by distance bolts (1). The distance bolts (1) have a cross slot (5) to receive the grate rod (3), and also a projecting piece (6) in the cross slot (5), which engages a corresponding recess (7) of the grate rod (3). The distance bolts (1) are secured against falling out by a surrounding cover ring (4). A pastelike plastic can be introduced into a lengthwise boring (8) of the distance bolt (1), fixing the grate upon hardening.

7 Claims, 2 Drawing Sheets

PIPE SPACING GRATE ROD SPACING HOLDER FOR HEAT EXCHANGERS

FIELD AND BACKGROUND OF THE INVENTION

The invention concerns a spacing holder for grate rods of a pipe spacing grate for guidance of pipes, e.g., in steam generators, whereby the grate is formed of intersecting grate rods, arranged in more than one plane and encircled by a frame, which has a groove running about the inside for reception of the ends of the grate rods.

The piping of heat exchangers requires maintenace of an exactly defined distance between the rods of the pipe grate. Maintenance of the geometrical structure of the grate is achieved, in particular, by securing the ends of the grate rods in the frame structure of the gridiron.

In the state of the art, the securing of the grate rods in the frame is done in different ways. In certain configurations, the grate rods are rigidly connected to the frame. In others, spacing yokes are provided, which allow a certain latitude of movement to the grid, which makes possible a thermal compensation. This compensation is important if the gridiron and frame consist of different materials.

SUMMARY OF AND OBJECT OF THE INVENTION

The goal of the invention is to create a spacing yoke in the encircling frame of a pipe spacing grate for guiding the pipe bundles of heat exchangers, especially steam generators, which both provides a secure fixation of the grate rods for the piping and the assembly, and avoids a positive locking of the grate rods, due to the fixation, during the operating condition of the heat exchanger, because the various thermal expansions between the grate rods and the frame caused by the different materials of the rods and the frame.

Accordingly it is an object of the invention to provide a spacing holder for the grate rods of a pipe spacing grate for guiding the pipes of heat exchangers including a grate formed of plurality of intersecting grate rods arranged in more than one plane said grate rods having recesses at the ends. The grate rods are positioned by a substantially cylindrical frame having a groove around the inside of the frame for reception of the ends of the grate rods. The frame includes plurality of bores communicating with the grove, having a central axis substantially parallel to the groove. A plurality of distance bolts are provided each of the bolts having a transverse slot for reception of one of said plurality of grate rods. Each of the said distance bolts having a projecting piece positioned in the transverse slot adapted to engage with a corresponding recess of an end of one of the plurality of grate rods so as to provide mutual spacing of the grate rods in the frame.

According to the invention distance bolts are employed so as to offer the possibility of using a single-part grate frame with the smallest possible profile cross section and assure an exact positioning in the grate frame. After the spacing of the grate rods in the frame is set by mounting the distance bolts, a pastelike plastic in introduced through a lengthwise boring in the distance bolt between the slot of the ebolt and the grate rod, which upon hardening produces a friction-type locking of the bolt and the grate rod. When the heat exchanger is in operation, this plastic becomes fluid and is washed away by the medium flowing about the holder at a certain temperature, so that temperature-dependent expansions within the structure of the grate rod and the frame can take place.

The various features of novelty which characterize the invention are pointed with particularity annexed to and forming a part of this disclosure. For a better understanding of the invention is operating advantages and specific objects obtained by its uses, reference is made to the accompanying drawings and descriptive matter in which a preferred embodiment of the invention is illustrated.

As shown by the figures, a distance bolt (1) is inserted in a boring 10 of the grate frame (2) and secured by a salient cover ring (4).

Figure 1:
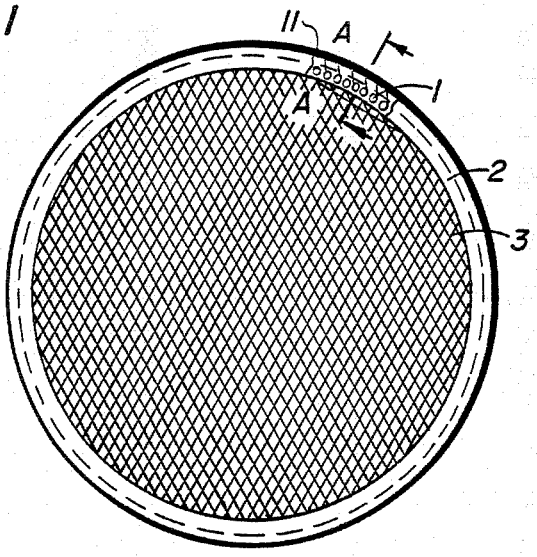
FIG. 1—top view of a pipe spacing grate with partial section.
Figure 2:
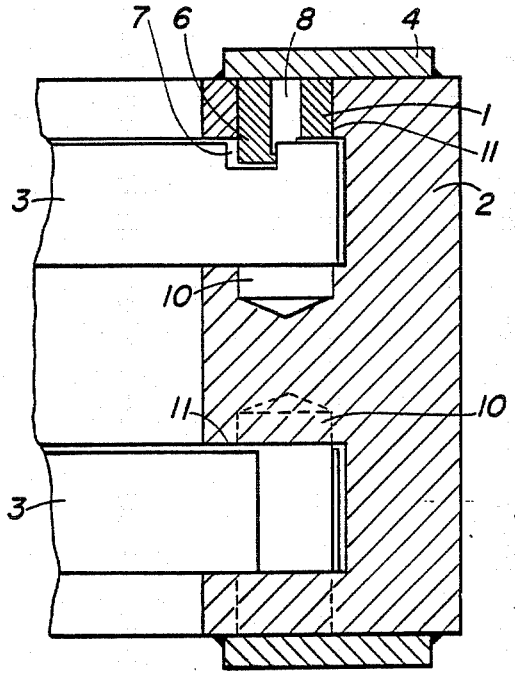
FIG. 2—lengthwise section of FIG. 1 along the line A—A.
Figure 3:
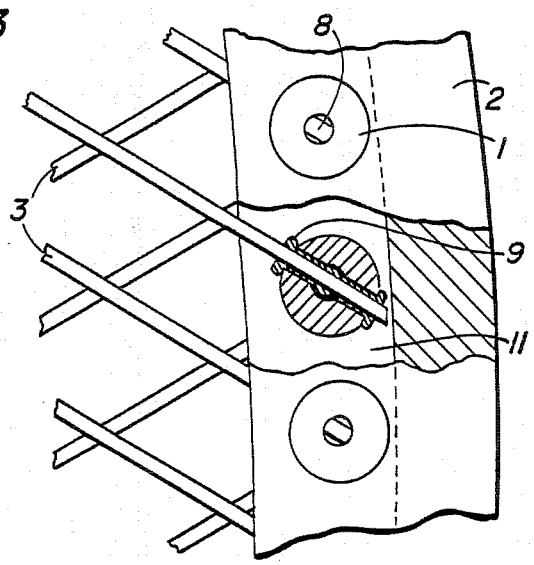
FIG. 3—partial top view with partial sections.
Figure 4:
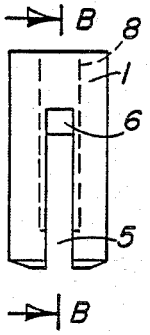
FIG. 4—front view of the distance bolt.
Figure 5:
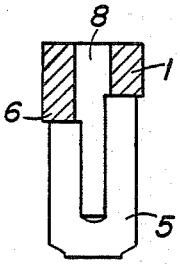
FIG. 5—a top sectional view taken along line B—B of FIG. 4.
Figure 6:
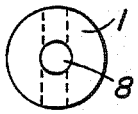
FIG. 6—Top view of the distance bolt.

The grate rods 3 are inserted in the grate frame 2 in a groove 11 formed around the inside of the grate frame 2. (See FIG. 2). The groove 11 intersects each of the borings 10 as can be seen in FIG. 3.

A cross slot (5) in the distance bolt (1) grasps the grate rod (3) and positions it in the grate frame (2).

With a projection (6) lying in the cross slot (5), the distance bolt engages a recess (7) of the grate rod (3) and thereby prevents its being pulled out of the grate frame (2). After filling the grate frame (2) with grate rods (3) and distance bolts (1), a pastelike plastic (9) is introduced between the slots of the bolts (5) and the gridiron rods (3) through a lengthwise boring (8). After hardening of the plastic (9), a friction-type locking is produced between the distance bolts (1) and the grate rods (3), so that the pipe spacing grate remains positioned and fixed in the grate frame (2) for the following process steps.

During operation, the plastic (9) is washed out by the medium flowing past it at a certain temperature, thereby releasing the grate rod (3) for temperature- dependent lengthwise expansions.

While a specific embodiment of the invention has been shown and described in detail to illustrate the application of the principals of the invention, it will be understood that the invention may be embodied otherwise without departing from such principals.

What is claimed is:

1. A space holder for grate rods of a pipe spacing grate for guiding pipes of heat exchangers, comprising: a grate formed of plurality of intersecting grate rods arranged in more than one plane said grate rods each having grate rod ends each end having a recess; a substantially cylindrical frame having a groove around the inside of said frame for reception of the ends of the grate rods, the frame including a plurality of bores communicating with the groove, each having a central axis; a plurality of distance bolts, each of said bolts having a transverse slot for reception of one of said plurality of grate rods, each of said distance bolts having a projecting piece positioned in the transverse slot adapted to engage with said corresponding recess of the end of one of said plurality of grate rods so as to provide mutual spacing of said grate rods in said frame.

2. A spacing holder for grate rods according to claim 1, wherein: said distance bolts are secured in the bores by a cover ring secured to said frame.

3. A spacing holder for grate rods according claim 1, wherein: said distance bolts are provided with a lengthwise boring.

4. A spacing holder for grate rods according claim 3, wherein: the bore of said distance bolt is a straight through bore.

5. A spacing holder for rate rods according claim 3, wherein: the bore of said distance bolt is a blind bore.

6. A spacing holder for grate rods according claim 1, wherein: said frame includes a plurality of grooves and corresponding sets of bores.

7. A spacing holder for grate rods according claim 3, further comprising: a pastelike plastic introduced through said lengthwise boring in the distance bolt between the slot of the bolt and the grate rod, which upon hardening produces a friction-type locking of the bolt and the grate rod said pastelike plastic becomes fluid during the heat exchanger operation and is washed away by the medium flowing about the holder at a certain temperature.

* * * * *